US007466740B2

(12) United States Patent
Lazor

(10) Patent No.: US 7,466,740 B2
(45) Date of Patent: Dec. 16, 2008

(54) INDUCTION COIL HAVING INTERNAL AND EXTERNAL FARADIC RINGS

(75) Inventor: David A. Lazor, Hubbard, OH (US)

(73) Assignee: AJAX Tocco Magnethermic Corporation, Euclid, OH (US)

( * ) Notice: Subject to any disclaimer, the term of this patent is extended or adjusted under 35 U.S.C. 154(b) by 259 days.

(21) Appl. No.: 11/439,855

(22) Filed: May 24, 2006

(65) Prior Publication Data

US 2007/0127542 A1 Jun. 7, 2007

Related U.S. Application Data

(60) Provisional application No. 60/749,015, filed on Dec. 7, 2005.

(51) Int. Cl.
*H05B 6/06* (2006.01)

(52) U.S. Cl. ..... 373/144; 373/151; 373/152; 156/345.48; 219/762

(58) Field of Classification Search ..... 373/144, 373/151, 152, 156, 139, 105, 27, 157; 219/635, 219/674, 634, 121.36, 121.54, 121.43, 121.48, 219/121.57, 121.41; 118/728, 723 R, 723 IR, 118/723 I, 723 MP, 723 E, 718, 719; 315/111.81, 315/111.51, 111.21; 204/298.15, 671; 156/643.1, 156/345.48; 427/569
See application file for complete search history.

(56) References Cited

U.S. PATENT DOCUMENTS

| | | | | |
|---|---|---|---|---|
| 3,762,912 | A | 10/1973 | Jacquerie et al. | |
| 4,174,462 | A | 11/1979 | Pearce | |
| 4,447,690 | A | 5/1984 | Grever | |
| 5,034,586 | A | 7/1991 | Havas et al. | |
| 5,495,094 | A | 2/1996 | Rowan et al. | |
| 6,121,592 | A | 9/2000 | Fishman et al. | |
| 6,632,324 | B2 * | 10/2003 | Chan | 156/345.48 |
| 2002/0033233 | A1 * | 3/2002 | Savas | 156/345.48 |

* cited by examiner

*Primary Examiner*—Quang T Van
(74) *Attorney, Agent, or Firm*—Sand & Sebolt

(57) ABSTRACT

An induction furnace includes a pair of induction coils with a pair of faraday rings disposed between the induction coils to substantially prevent mutual inductance between the first and second induction coils. The induction coils preferably have a different size circumference and may be coplanar. The prevention of mutual inductance provided by the faraday rings is particularly useful for a pusher furnace in which adjacent furnace sections are heated to different and rather specific temperatures.

20 Claims, 5 Drawing Sheets

INDUCTION COIL HAVING INTERNAL AND EXTERNAL FARADIC RINGS

CROSS REFERENCE TO RELATED APPLICATIONS

This application claims priority from U.S. Provisional Application Ser. No. 60/749,015 filed Dec. 7, 2005; the disclosure of which is incorporated herein by reference.

BACKGROUND OF THE INVENTION

1. Technical Field

The invention relates generally to induction furnaces. More particularly, the invention relates to induction furnaces which utilize a plurality of induction coils for heating adjacent sections of the furnace. Specifically, the invention relates to the use of inner and outer faraday rings disposed between adjacent induction coils to prevent mutual induction between the adjacent induction coils.

2. Background Information

Induction furnaces are well-known in the art and typically utilize one or more induction coils to heat the furnace via a susceptor or via direct inductive heating of the load within the furnace. Pusher furnaces or the like involve a plurality of sections which form an elongated passage through which the load is conveyed in order to most typically provide continuous heating of the load within heating sections of the furnace. Faraday rings are well known for reducing the mutual induction between the pair of adjacent induction coils. However, current known arrangements are not able to sufficiently eliminate the mutual inductance between the coils which is necessary to independently operate the induction coils for a variety of purposes. The present invention addresses this and other problems.

BRIEF SUMMARY OF THE INVENTION

The present invention provides an induction furnace comprising a first heating section including a first induction coil; a second heating section including a second induction coil adjacent the first induction coil and spaced therefrom; first and second faraday rings disposed between the first and second induction coils to help prevent mutual inductance between the first and second induction coils.

BRIEF DESCRIPTION OF THE SEVERAL VIEWS OF THE DRAWINGS

Similar numbers refer to similar parts throughout the drawings.

DETAILED DESCRIPTION OF THE INVENTION

Figure 1:
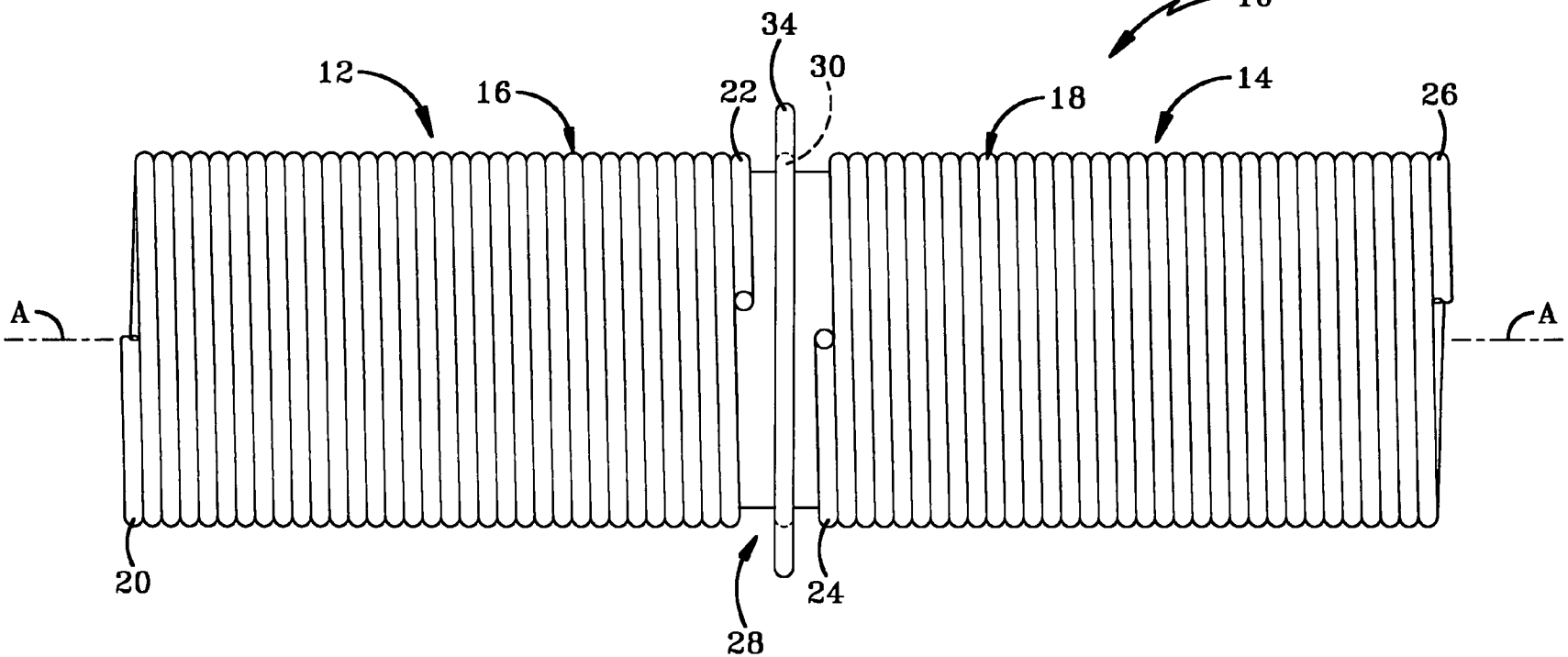
FIG. 1 is a diagrammatic side view of the induction furnace of the present invention showing the inner and outer faraday rings.
Figure 2:
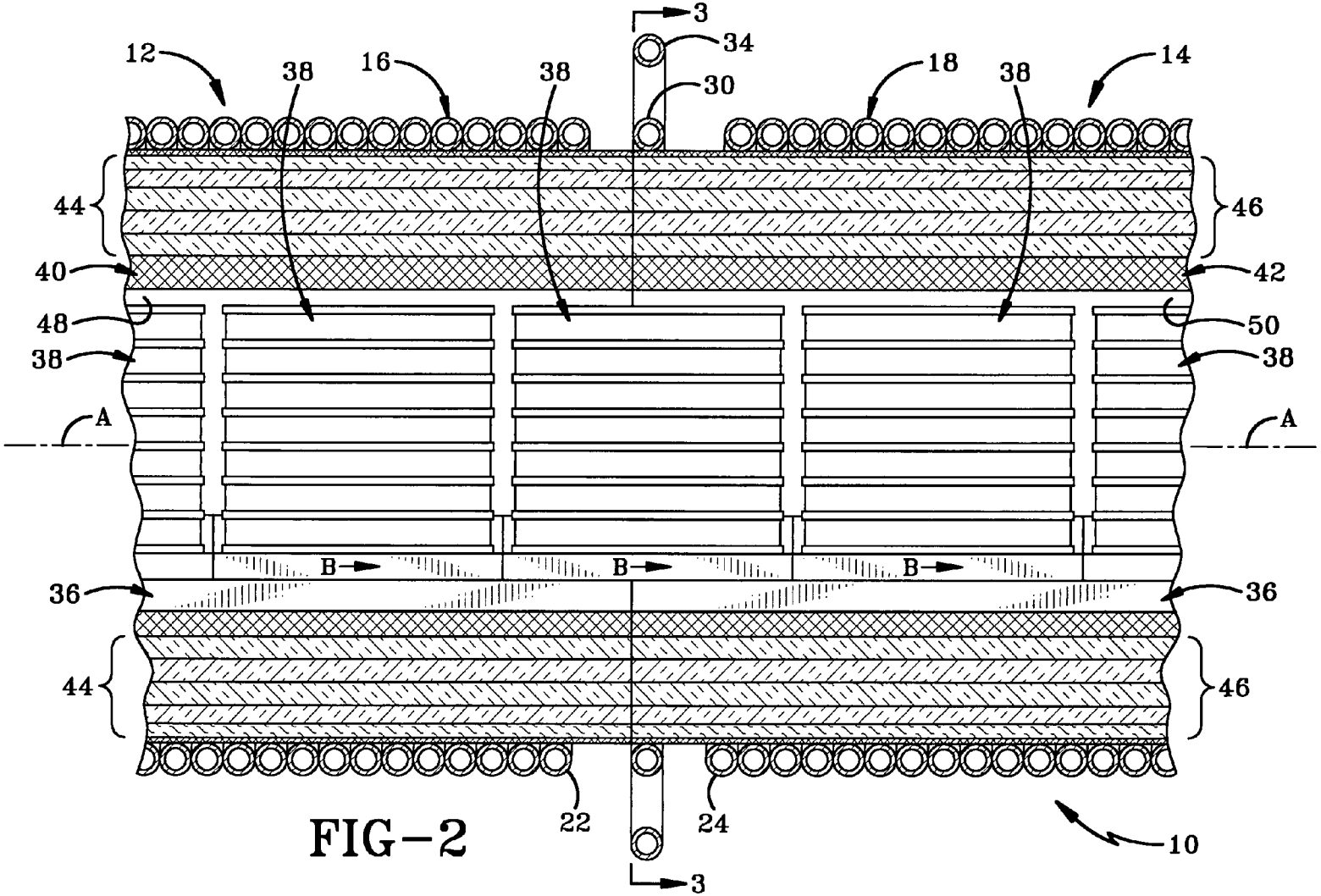
FIG. 2 is an enlarged fragmentary sectional view taken from the side of the furnace in FIG. 1.
Figure 5:
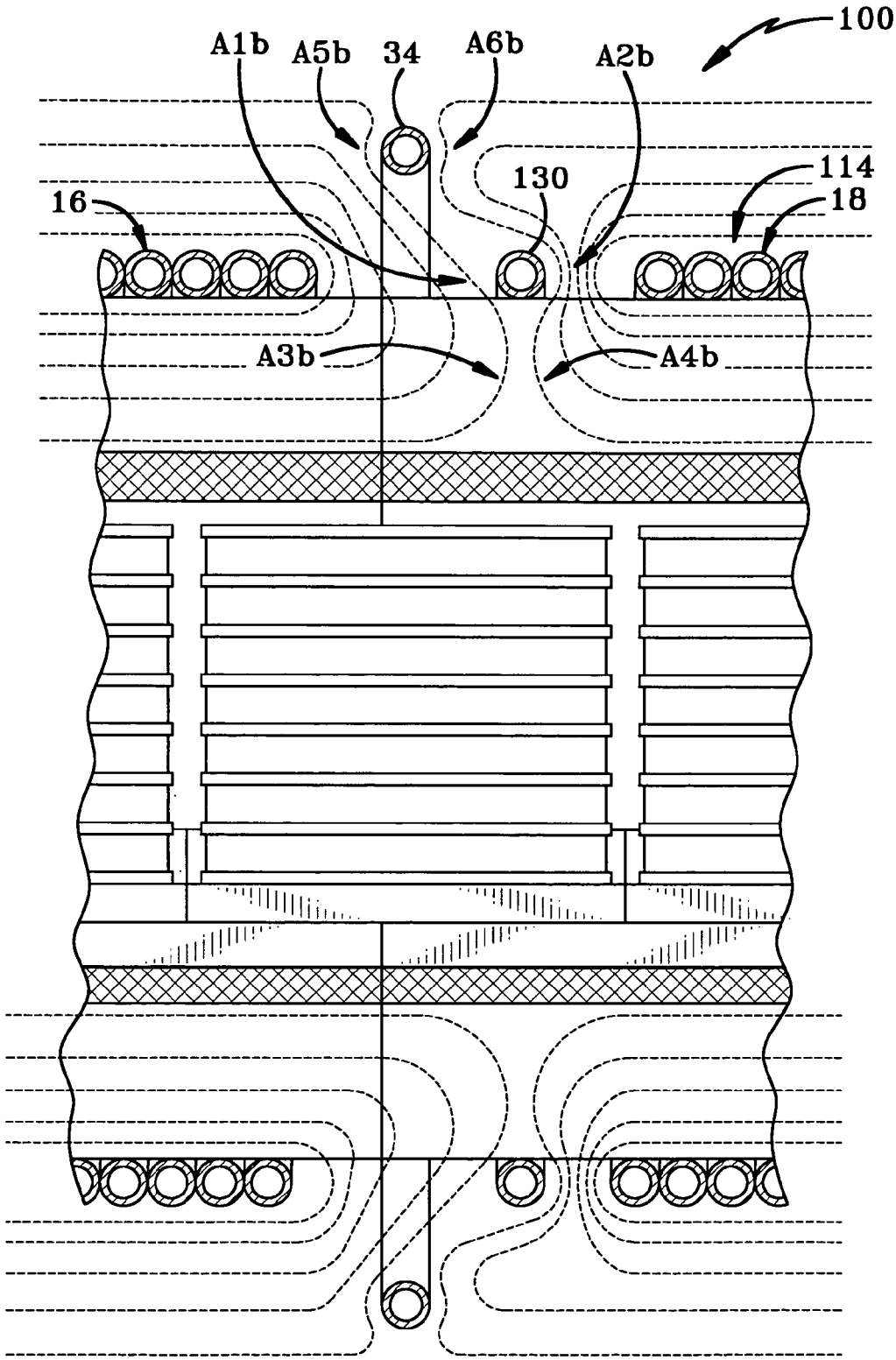
FIG. 5 is similar to FIG. 4 and shows a second embodiment of the induction furnace with the inner and outer faraday rings spaced differently than in the first embodiment.

A first embodiment of the induction furnace of the present invention is indicated generally at 10 in FIGS. 1-2; and a second embodiment of the induction furnace is indicated generally at 100 in FIG. 5. Referring to FIG. 1, induction furnace 10 includes first and second sections 12 and 14 which are disposed laterally adjacent one another. First section 12 includes a first induction coil 16 and second section 14 includes a second induction coil 18. First induction coil 16 has first and second ends 20 and 22 defining therebetween a longitudinal direction which is the same as the longitudinal direction of furnace 10. Likewise, second coil 18 has first and second ends 24 and 26 defining therebetween a longitudinal direction which is the same as that of coil 16 and furnace 10. First end 20 of coil 16 is an entry end and a second end 26 of coil 18 is an exit end. Second end 22 of first coil 16 is adjacent and spaced from first end 24 of second coil 18 and thus defines therebetween a space 28 in which are disposed inner faraday ring 30 and an outer faraday ring 34, each formed of a metal. Induction coils 16 and 18 and faraday rings 30 and 34 are all formed about a longitudinal axis A which is substantially horizontal. Inner ring 30 and outer ring 34 generally lie along a common plane which is substantially perpendicular to axis A.

Referring to FIG. 2, furnace 10 further includes a conveying platform 36 such as slide rails extending in the longitudinal direction along which a plurality of loads 38 move in the direction of Arrows B in FIG. 2 from entrance end 20 of coil 16 to exit end 26 of coil 18. First section 12 includes a first susceptor 40 associated with first induction coil 16 and second section 14 includes a second susceptor 42 associated with second induction coil 18. First section 12 further includes several insulation layers 44 of refractory material disposed between susceptor 40 and first induction coil 16. Likewise, second section 14 further includes a plurality of insulation layers 46 of refractory materials disposed between susceptor 42 and second induction coil 18. First susceptor 40 defines a first passage 48 and second susceptor 42 defines a second passage 50 aligned with passage 48. As previously noted, sections 12 and 14 typically will abut one another so that passages 48 and 50 are a continuous longitudinally extending heating passage. Conveying platform 36 extends through first and second passages 48 and 50 in order to convey loads 38 therethrough.

Figure 3:
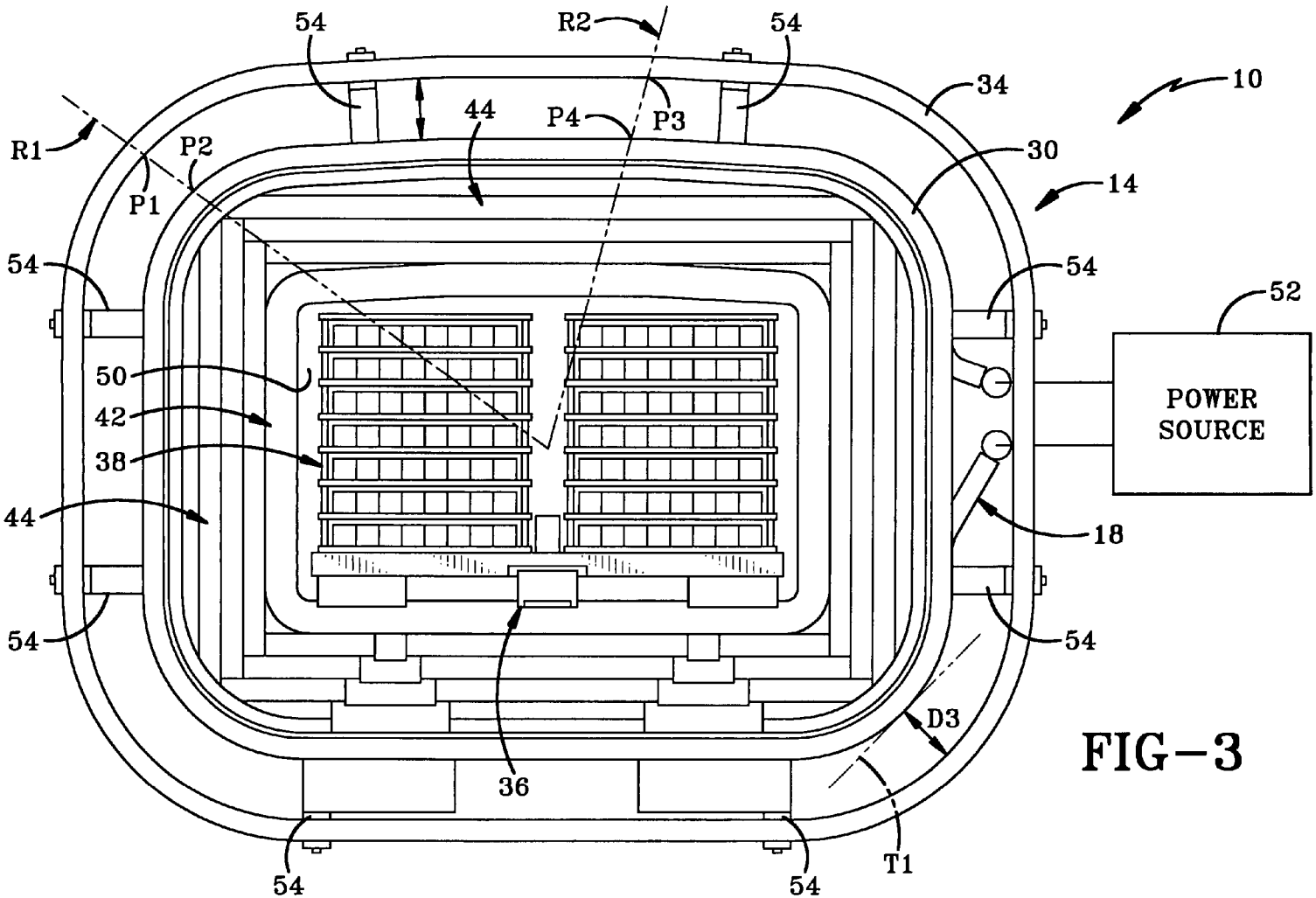
FIG. 3 is a sectional view taken on line 3-3 of FIG. 2.

Referring to FIG. 3, furnace 10 further includes a power source 52 in electrical communication with second induction coil 18. First induction coil 16 is likewise in electrical communication with a power source (not shown) so that the power sources respectively power induction coils 16 and 18 separately. Inner and outer rings 30 and 34 are mounted to one another via a plurality of radially extending mounting structures 54.

In accordance with the invention and with continued reference to FIG. 3, inner faraday ring 30 forms a continuous loop having a shape and outer faraday ring 34 forms a continuous loop having a shape which is substantially the same as the shape of inner faraday ring 30 except that it is larger. More particularly, each point along the continuous loop of outer ring 34 is spaced radially outwardly from a respective associated radial point of inner ring 30. This is illustrated in FIG. 3 with a first radius R1 and second radius R2 which extend from axis A. Radius R1 intersects the inner surface of outer ring 34 at a point P1 which is radially outwardly of point P2, which is the intersection of radius R1 and the outer surface of inner ring 30. Likewise and by way of further example, point P3 on radius R2 is disposed radially outwardly of point P4 wherein points P3 and P4 are analogous to points P1 and P2 with regard to radius R2. Most preferably, the normal distance D3 (FIG. 3) between inner ring 30 and outer ring 34 is substantially the same all along the continuous loop. More particularly, in the lower right of FIG. 3, a tangent T1 to the outer surface of inner ring 30 is shown with distance D3 being perpendicular to tangent T1. Tangent T1 is thus representative of any tangent along the outer surface of inner ring 30. In the exemplary embodiment, inner ring 30 and outer ring 34 each have a shape which is generally rectangular with rounded corners. This is likewise true of susceptor 42 and coils 16 and 18. However, the shape of these various structures may vary in accordance with the particular configuration of the furnace desired.

Figure 4:
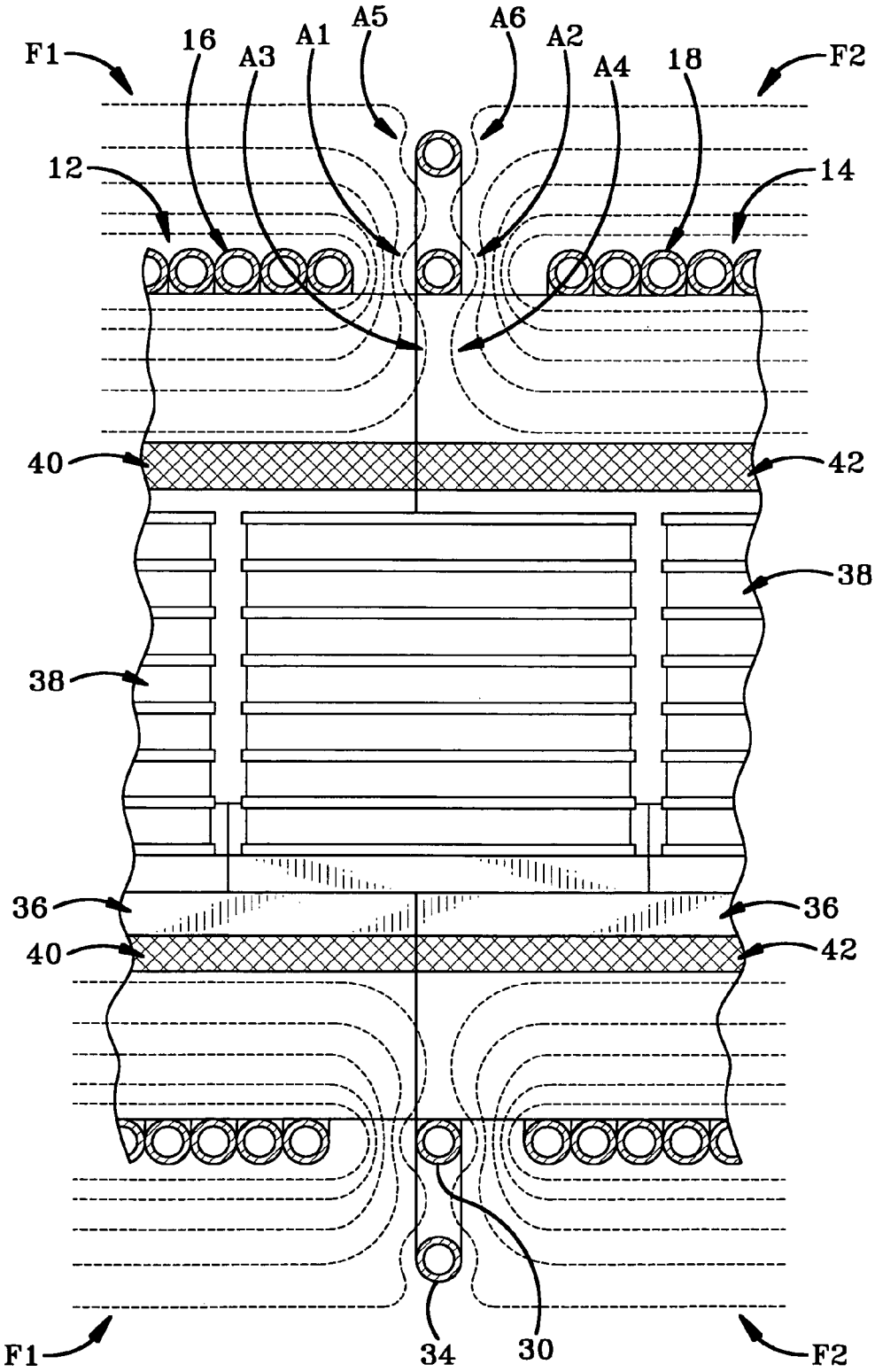
FIG. 4 is a fragmentary sectional view similar to FIG. 2 diagrammatically showing the electromagnetic field produced by the induction coils and the effect of the faraday rings thereon.

In accordance with the invention and with reference to FIG. 4, when the respective power sources are operated to power induction coils 16 and 18, induction coil 16 produces a magnetic field F1 and induction coil 18 produces a magnetic field F2 respectively represented at the dashed flux lines in FIG. 4. As is well known in the art, induction coil 16 couples with susceptor 40 via magnetic field F1 and induction coil 18 couples with susceptor 42 via magnetic field F2 and respectively inductively heats susceptors 40 and 42 to transfer heat to loads 38. Inner ring 30 limits the effect of magnetic field F1 in the longitudinal direction toward second induction coil 18 as indicated by the altered magnetic flux lines at area A1. Similarly, inner ring 30 limits the longitudinal effect of magnetic field F2 toward induction coil 16 as indicated at the altered magnetic flux lines of area A2. Inner ring 30 and susceptor 40 in combination prevent the portion of magnetic field F1 radially inwardly of ring 30 from affecting induction coil 18, as indicated at area A3. Likewise, inner ring 30 in combination with susceptor 42 prevent field F2 from affecting induction coil 16 as indicated at area A4. However, inner ring 30 is not sufficient to eliminate or substantially eliminate the inductive effect of magnetic field F1 on induction coil 18 and the effect of magnetic field F2 on induction coil 16.

In accordance with the invention, outer ring 34 prevents the portion of magnetic field F1 which is radially outward of inner ring 30 from extending longitudinally toward second coil 18 to produce electromagnetic induction therein, as indicated at area A5. Likewise, outer ring 34 limits the longitudinal reach of magnetic field F2 external to inner ring 30 toward induction coil 16 to prevent inductance therein caused by field F2. Without outer ring 34, induction coils 16 and 18 would create magnetic fields which cause mutual inductance in one another and thus alter the amount of energy being absorbed by susceptors 40 and 42. Such mutual inductance would also affect the respective power sources, such as power source 52 which are connected to induction coil 16 and 18. Such mutual inductance prevents the ability to independently control induction coils 16 and 18 in order to provide the desired inductive heating respectively within sections 12 and 14 of furnace 10. The use of outer faraday ring 34 eliminates or substantially eliminates the mutual inductance between coils 16 and 18 so that they are independently operable. This allows the independent control of coils 16 and 18 to provide the specific desired heating effect within each of sections 12 and 14. This is especially useful when it is desired to create specific temperature zones, for example a first zone within section 12 and a second zone within section 14 having different temperatures or temperature ranges. This ability to closely control such temperature zones allows for the production of certain loads 38 which require close control of the temperatures within certain zones for specific periods of time as the loads pass through the different heating zones.

With reference to FIG. 5, induction furnace 100 is described. Furnace 100 is substantially the same as furnace 10 except that furnace 100 includes a second section 114 which is slightly altered to accommodate an inner ring 130 which is positioned differently with respect to outer ring 34 than in the first embodiment. Furnace 10 is shown primarily to indicate that the inner and outer faraday rings do not have to be substantially coplanar with one another. Thus, section 114 includes additional space between the end thereof and second coil 18 in which is disposed inner faraday ring 130. More particularly, inner ring 130 is disposed intermediate outer faraday ring 34 and second induction coil 18 in the longitudinal direction. Although inner ring 130 is longitudinally offset from outer ring 34, the effect is the same in the ability to prevent mutual inductance between induction coils 16 and 18. FIG. 5 has been marked with areas A1*b*, A2*b*, A3*b*, A4*b*, A5*b* and A6*b* which are analogous to areas A1-A6 in FIG. 4 and thus are not further detailed.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An induction furnace comprising:

a first heating section including a first induction coil;

a second heating section including a second induction coil adjacent the first induction coil and spaced therefrom;

first and second faraday rings disposed between the first and second induction coils to help prevent mutual inductance between the first and second induction coils; and wherein the first faraday ring has a circumference which is smaller than that of the second faraday ring;

and the first and second faraday rings are oriented along a common plane.

2. The furnace of claim 1 wherein the faraday rings circumscribe a common line which is perpendicular to the plane.

3. The furnace of claim 2 wherein the faraday rings define respective circumferential shapes which are substantially the same except the shape of the first ring is smaller than that of the second ring.

4. The furnace of claim 3 wherein the common line defines a common center of the faraday rings.

5. An induction furnace comprising:

a first heating section including a first induction coil;

a second heating section including a second induction coil adjacent the first induction coil and spaced therefrom;

first and second faraday rings disposed between the first and second induction coils to help prevent mutual inductance between the first and second induction coils;

wherein the first and second faraday rings are respectively oriented substantially along first and second parallel planes which are spaced from one another; and the faraday rings circumscribe a common line which is perpendicular to the parallel planes.

6. The furnace of claim 5 wherein the first faraday ring has a circumference which is smaller than that of the second faraday ring.

7. The furnace of claim 6 wherein the common line defines a common center of the faraday rings.

8. The furnace of claim 7 wherein the faraday rings define respective circumferential shapes which are substantially the same except the shape of the first ring is smaller than that of the second ring.

9. An induction furnace comprising:

a first heating section including a first induction coil;

a second heating section including a second induction coil adjacent the first induction coil and spaced therefrom;

first and second faraday rings disposed between the first and second induction coils to help prevent mutual inductance between the first and second induction coils, wherein the faraday rings are substantially coplanar and circumscribe a common center.

10. An induction furnace comprising:

a first heating section including a first induction coil;

a second heating section including a second induction coil adjacent the first induction coil and spaced therefrom;

first and second faraday rings disposed between the first and second induction coils to help prevent mutual inductance between the first and second induction coils; and wherein each of the induction coils and faraday rings circumscribe a common line.

11. The furnace of claim 10 wherein the first and second faraday rings are oriented along a common plane.

12. The furnace of claim 1 claim 10 wherein the first and second faraday rings are respectively oriented substantially along first and second parallel planes which are spaced from one another.

13. An induction furnace comprising:

a first heating section including a first induction coil;

a second heating section including a second induction coil adjacent the first induction coil and spaced therefrom;

first and second faraday rings disposed between the first and second induction coils to help prevent mutual inductance between the first and second induction coils;

a susceptor which extends through the first and second induction coils; and wherein the first and second rings circumscribe the susceptor.

14. The furnace of claim 13 wherein the first and second faraday rings are respectively oriented substantially along first and second parallel planes which are spaced from one another.

15. The furnace of claim 14 wherein the faraday rings circumscribe a common line which is perpendicular to the parallel planes.

16. The furnace of claim 15 wherein each point along the circumference of the second faraday ring is spaced radially outwardly from the common line further than is a respective associated radial point of the first faraday ring.

17. The furnace of claim 16 wherein the common line defines a common center of the faraday rings.

18. The furnace of claim 13 wherein the faraday rings are substantially coplanar.

19. The furnace of claim 13 wherein the susceptor includes a plurality of susceptor segments arranged in end to end abutment with one another.

20. The furnace of claim 13 wherein the first faraday ring has a circumference which is smaller than that of the second faraday ring.

* * * * *